US012291817B2

(12) United States Patent
Prokein et al.

(10) Patent No.: US 12,291,817 B2
(45) Date of Patent: May 6, 2025

(54) METHOD FOR THE DYEING OF LEATHER AND DYED LEATHER HAVING A HIGH RUBBING FASTNESS

(71) Applicant: Fraunhofer-Gesellschaft zur Förderung der angewandten Forschung e.V., Munich (DE)

(72) Inventors: Michael Prokein, Oberhausen (DE); Manfred Renner, Essen (DE)

(73) Assignee: Fraunhofer-Gesellschaft zur Förderung der angewandten Forschung e.V., Munich (DE)

( * ) Notice: Subject to any disclaimer, the term of this patent is extended or adjusted under 35 U.S.C. 154(b) by 93 days.

(21) Appl. No.: 18/013,129

(22) PCT Filed: Jun. 28, 2021

(86) PCT No.: PCT/EP2021/067629
§ 371 (c)(1),
(2) Date: Dec. 27, 2022

(87) PCT Pub. No.: WO2022/002821
PCT Pub. Date: Jan. 6, 2022

(65) Prior Publication Data

US 2023/0141950 A1 May 11, 2023

(30) Foreign Application Priority Data

Jun. 30, 2020 (DE) ..... 10 2020 117 164.1

(51) Int. Cl.
*D06P 1/00* (2006.01)
*D06P 1/94* (2006.01)
*D06P 3/32* (2006.01)

(52) U.S. Cl.
CPC . *D06P 1/94* (2013.01); *D06P 3/32* (2013.01)

(58) Field of Classification Search
CPC ..... D06P 1/94; D06P 3/32
USPC ..... 8/436
See application file for complete search history.

(56) References Cited

U.S. PATENT DOCUMENTS 6,676,710 B2 1/2004 Smith et al.

FOREIGN PATENT DOCUMENTS

| | | | | |
|---|---|---|---|---|
| CN | 107142757 | | 9/2017 | |
| CN | 107142757 A | * | 9/2017 | ..... D06P 1/94 |
| CN | 109137573 | | 4/2021 | |
| DE | 10251136 A1 | | 5/2004 | |
| WO | 2020221407 A1 | | 11/2020 | |

OTHER PUBLICATIONS

Drumond et al.: "Eco-Friendly Textile Dyeing and Finishing", 2013, INTECH, article "Textile Dyes: Dyeing Process and Environmental Impact".

(Continued)

*Primary Examiner* — Eisa B Elhilo
(74) *Attorney, Agent, or Firm* — Andrus Intellectual Property Law, LLP

(57) ABSTRACT

A method for dyeing leather with an organic colorant in a supercritical fluid. The method includes coating a surface of the leather to provide a coated surface of the leather. The method further includes dyeing the coated surface of the leather with the organic colorant in the supercritical fluid.

18 Claims, 3 Drawing Sheets

(56) References Cited

OTHER PUBLICATIONS

Forgacs et al.: "Removal of synthetic dyes from wastewaters: a review", Environment International, vol. 30, No. 7, 2004, pp. 953-971.
Hussain et al.: "A critical review of the current water conservation practices in textile wet processing", Journal of Cleaner Production, vol. 198, 2018, pp. 806-819.
International Search Report for corresponding International Patent Application No. PCT/EP2021/067629 mailed Nov. 21, 2022.
German Office Action in German Patent Application No. 10 2020 117 164.1 dated Feb. 1, 2021.

* cited by examiner 0,04 g/ft$^2$ 0,10 g/ft$^2$ 0,12 g/ft$^2$ 0,14 g/ft$^2$ 0,04 g/ft$^2$ 0,14 g/ft$^2$ 0,16 g/ft$^2$ 0,18 g/ft$^2$ 0,22 g/ft$^2$ 0,36 g/ft$^2$ 0,38 g/ft$^2$ 0,40 g/ft$^2$ 0,10 g/ft$^2$ 0,12 g/ft$^2$ 0,14 g/ft$^2$ 0,10 g/ft$^2$ 0,12 g/ft$^2$ 0,14 g/ft$^2$

METHOD FOR THE DYEING OF LEATHER AND DYED LEATHER HAVING A HIGH RUBBING FASTNESS

CROSS REFERENCE TO RELATED APPLICATION

This application is the U.S. national stage application of International Application No. PCT/EP2021/067629, filed Jun. 28, 2021, which International Application was published on Jan. 6, 2022, as International Publication WO 2022/002821 in the German language. The International Application claims priority to German Application No. 10 2020 117 164, filed Jun. 30, 2020. The International Application and German Application are hereby incorporated herein by reference in their entireties.

FIELD

The present invention relates to the technical field of leather manufacturing.

BACKGROUND

In the global market for tanned and finished leather, revenues averaged $82 billion annually from 2012 to 2014. More than 1 billion square meters of "light leather" are produced annually from cattle hides alone. Light leather is considered a surface material and is used for footwear, furniture, apparel, and leather goods.

As discussed further below, the industry has standards for what constitutes a high rub fastness RFT, which is determined according to ISO 11640:2012 and ISO 105 A03.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One embodiment of the present disclosure generally relates to a method for dyeing leather with an organic colorant in a supercritical fluid. The method includes coating a surface of the leather to provide a coated surface of the leather. The method further includes dyeing the coated surface of the leather with the organic colorant in the supercritical fluid.

Another embodiment generally relates to a method for dyeing leather having a coating on its surface. The method includes dyeing the coating with an organic colorant in a supercritical fluid such that the coating of the leather is dyed with a high rub fastness.

Another embodiment generally relates to a method for dyeing a product comprising a leather having a coating on its surface. The method includes dyeing the coating with an organic colorant in a supercritical fluid such that the coating of the product is dyed with a high rub fastness.

Various other features, objects and advantages of the disclosure will be made apparent from the following description taken together with the drawings.

BRIEF DESCRIPTION OF THE DRAWINGS

The present disclosure is described with reference to the following drawings.

DETAILED DISCLOSURE

Figure 1:
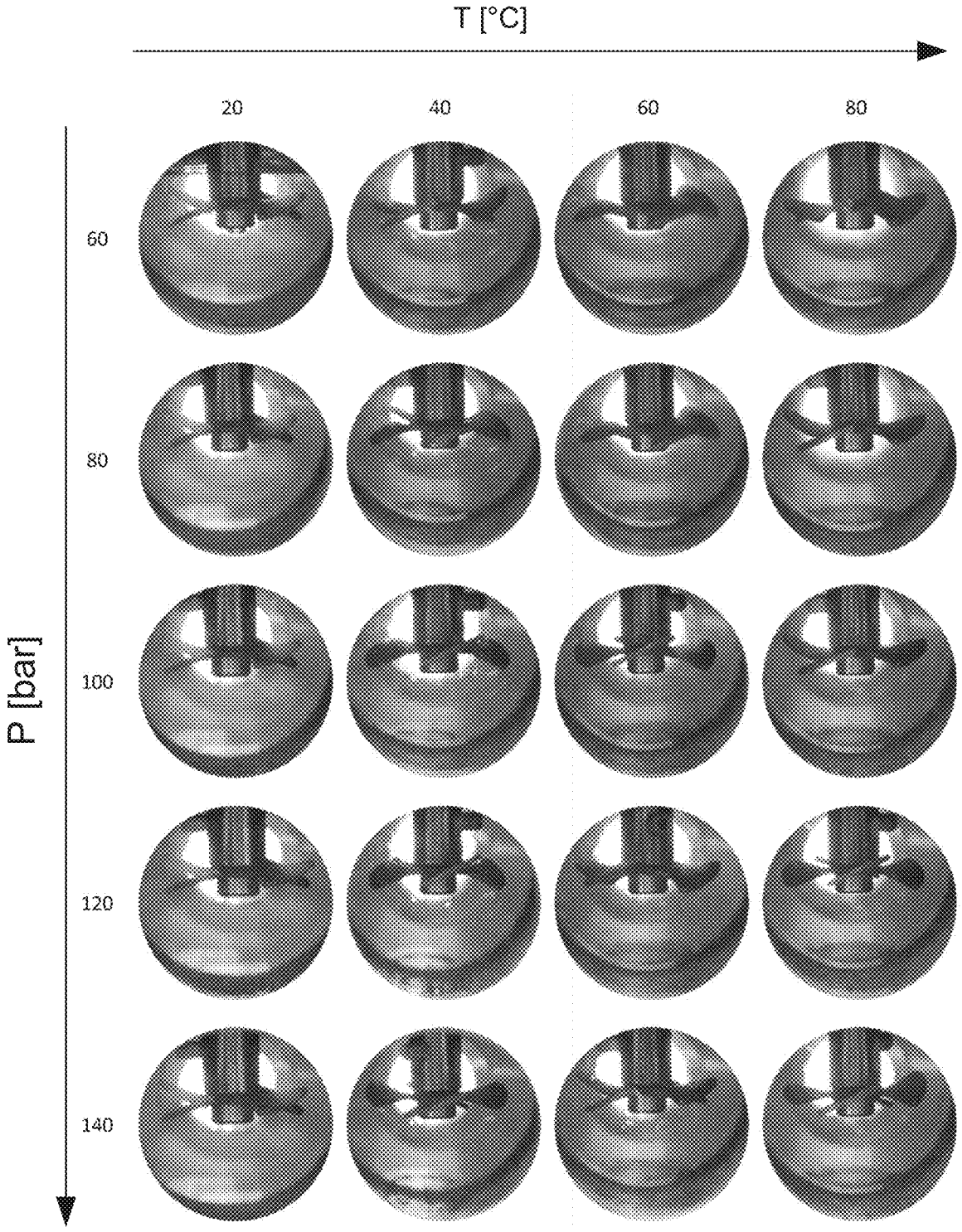
FIG. 1 depicts a solubility study for an exemplary organic colorant, specifically Solvent Red 111, wherein solubility in a supercritical fluid at increasing temperatures and pressures is shown.

Overall, the market for leather made from cattle hides alone has grown at an average annual rate of 1.4% over the past 15 years (FAO (2016): World statistical compendium for raw hides and skins, leather, and leather footwear 1999-2015). 50 wt. %. In comparison, the water content of finished leather is approx. 7 to 15 wt. % (Faber, Kurt; Herfeld, Hans (1990): Tanning agents, tanning, retanning. 2nd ed. 10 vols. Frankfurt am Main: Umschau-Verl.).

Conventionally, the leather surface can also be dyed during finishing by rolling or spraying. The advantage of rolling is that no excess dyes are required. Excess dye can be separated and reused. However, this technique is only applicable to a few leather products. For example, leathers with textured surfaces can only be dyed by spraying. Thus, 80 to 90% of the surface coloring of leather is done by spraying a water-based lacquer. However, depending on the different spraying machines and leather coatings, 15 to 40% of the dyes used in spray processes are lost through overspray and end up in the wastewater. Dye consumption is therefore low. Furthermore, conventionally dyed leathers using water-based systems in standardized methods only achieve optimum rub fastness properties if an additional transparent coating layer is applied over the dyed layer after dyeing. Leathers in which this layer is not applied generally discolor, in particular on contact with water or perspiration.

Furthermore, finishing also includes the final work on a tanned, dyed and/or greased leather. Finishing mainly serves the purpose of enhancing the surface. Here, the desired optical properties of leather include certain hues, various patterns, glossy or matte surfaces and long-lasting protection against wear. In addition, certain requirements are placed on the hardness, friction resistance, elasticity and buckling resistance of the leather. To meet all these requirements, several coatings with different materials are usually applied to the surface of the leather or the grain side. A common finish provides the leather with a transparent protective film, for example.

All these manufacturing steps from the animal hide to the finished leather consume in particular large amounts of water, energy, and chemicals. Depending on the preparation process, up to 50 m3 of fresh water is used to process one ton of raw hide into leather. The dyeing of leather consumes in particular large quantities of water. Accordingly, the dyeing processes also generate not inconsiderable quantities of wastewater, which may be heavily contaminated.

Dyeing processes are considered highly inefficient in the entire textile industry. An estimated 0.7 megatons of textile dyes are synthesized annually, of which 0.2 megatons end up in wastewater. This corresponds to a dye loss of about 30% or a dye consumption of only 70%. Without treatment of the wastewater, contamination with dye residues can result in considerable environmental pollution.

Numerous steps are required in producing leather from the according animal skins. Depending on the product, more than 35 steps may be required to produce fully tanned and finished leather from the animal hides. The hide—also known as corium—represents the part of the animal skin that is processed into leather. The corium is mainly composed of collagenous connective tissue structures.

Finished leather contains between 40% and 65% collagen and a water content of about 14%. However, the water content depends on the ambient conditions and is therefore not constant. The remaining residue is made up of chemicals from the leather manufacturing process and fatty substances. Here, too, there can be significant fluctuations due to differences in the producing process. As part of the producing process, the hides are first preserved in the slaughterhouse as a waste product of meat production. Preservation is usually done by cooling and salting the hides. The hides are then transported to the tannery. Here, the hides pass through a process chain that can be divided into water workshop, retanning and finishing.

In the water workshop, the hides are treated with additives in aqueous baths known as liquors. In this process, undesirable components such as hair, fat and/or flesh residues are removed. In a further step, the skin is tanned to obtain the collagen fibers of the skin. In this process, the protein structures are stabilized by chemical compounds.

In the folding process, the leather is moved over rotating blades. These remove material from the flesh side, wherein the flesh side corresponds to the part of the skin that lies inside the animal. The counterpart of the flesh side is the grain side, which can also be regarded as the upper side or surface of the leather. Through the folding process, a uniform thickness of the leather is achieved. The result of the water workshop is a durable leather that usually comprises a grayish-bluish color.

After the water workshop, retanning can take place. Retanning comprises the steps between tanning and finishing. Here, further substances are added to the leather in order to adjust the desired properties depending on further use. These desired properties include the color, water impermeability, and feel of the leather. Many retanning processes take place in parallel. For example, a liquor may obtain dyes and fats, making the leather colored, hydrophobic and softer.

In traditional dyeing, the leather is dyed in many color steps parallel to other retanning processes. A dye input of 1 to 3 wt. %, based on the shaved weight of the leather, is usual, but dye inputs of up to 10 wt. % are not uncommon. The fold weight describes the weight of the leather after folding. After folding, the water content of the leather is approx. 45 to 50 wt. %. In comparison, the water content of finished leather is approx. 7 to 15 wt. % (Faber, Kurt; Herfeld, Hans (1990): Tanning agents, tanning, retanning. 2nd ed. 10 vols. Frankfurt am Main: Umschau-Verl.).

Conventionally, the leather surface can also be dyed during finishing by rolling or spraying. The advantage of rolling is that no excess dyes are required. Excess dye can be separated and reused. However, this technique is only applicable to a few leather products. For example, leathers with textured surfaces can only be dyed by spraying. Thus, 80 to 90% of the surface coloring of leather is done by spraying a water-based lacquer. However, depending on the different spraying machines and leather coatings, 15 to 40% of the dyes used in spray processes are lost through overspray and end up in the wastewater. Dye consumption is therefore low. Furthermore, conventionally dyed leathers using water-based systems in standardized methods only achieve optimum rub fastness properties if an additional transparent coating layer is applied over the dyed layer after dyeing. Leathers in which this layer is not applied generally discolor, in particular on contact with water or perspiration.

Furthermore, finishing also includes the final work on a tanned, dyed and/or greased leather. Finishing mainly serves the purpose of enhancing the surface. Here, the desired optical properties of leather include certain hues, various patterns, glossy or matte surfaces and long-lasting protection against wear. In addition, certain requirements are placed on the hardness, friction resistance, elasticity and buckling resistance of the leather. To meet all these requirements, several coatings with different materials are usually applied to the surface of the leather or the grain side. A common finish provides the leather with a transparent protective film, for example.

All these manufacturing steps from the animal hide to the finished leather consume in particular large amounts of water, energy, and chemicals. Depending on the preparation process, up to 50 m3 of fresh water is used to process one ton of raw hide into leather. The dyeing of leather consumes in particular large quantities of water. Accordingly, the dyeing processes also generate not inconsiderable quantities of wastewater, which may be heavily contaminated.

Dyeing processes are considered highly inefficient in the entire textile industry. An estimated 0.7 megatons of textile dyes are synthesized annually, of which 0.2 megatons end up in wastewater. This corresponds to a dye loss of about 30% or a dye consumption of only 70%. Without treatment of the wastewater, contamination with dye residues can result in considerable environmental pollution.

In particular, due to consumer demands regarding the longevity of colors, dyes are often also designed to resist biodegradation. The reactive dye Reactive Blue 19, for example, comprises a half-life for its biodegradation of 46 years at a pH value of 7 and a temperature of 25° C. This is further complicated by the fact that there are no standardized purification processes for contaminated wastewater, as a large number of different additives are usually mixed into dye or colorant compositions.

Although isolated projects have achieved an 80 to 90% reduction in dye waste generated, no disposal solutions or uses are yet known for the ultimate resulting sludge (Drumond et al. (2013): Textile Dyes: Dyeing Process and Environmental Impact. In: Melih Gunay (ed.): Eco-Friendly Textile Dyeing and Finishing: InTech.). As a result, dye residues can sometimes remain in the environment for a long time and cause long-term damage. In water, for example, dyes absorb certain wavelengths of light, so that the photosynthesis of aquatic plants can be disturbed. In addition, dyes can accumulate in the gills of fish. This is problematic in particular because some dyes are toxic or considered carcinogenic (Forgacs et al. (2004): Removal of synthetic dyes from wastewaters: a review. In: Environment international 30 (7), pp. 953-971; Przystaś et al. (2012): Biological Removal of Azo and Triphenylmethane Dyes and Toxicity of Process By-Products. In: Water, air, and soil pollution 223 (4), pp. 1581-1592). To avoid these negative impacts on the environment, comparatively expensive water treatment is necessary. In Europe, for example, water treatment accounts for 4.3% of total sales in the leather industry. This compares to a profit margin of about 5% (Contance (ed.) (2012): Social and Environmental Report). Estimates suggest that a 20% reduction in process water alone could reduce process costs by 15% (Hussain et al. (2018): A critical review of the current water conservation practices in textile wet processing. In: Journal of Cleaner Production 198, pp. 806-819).

Against this background, it would therefore be desirable in particular to find a way or develop a method specifically for dyeing leather that requires less or ideally only very small amounts of water and still delivers a reliable and high-quality dyeing result.

It would also be desirable to develop a method that is superior to known dyeing methods in the leather industry in terms of its efficiency, i.e., for example, with regard to the quantities of dye required and also the quantities of waste produced, and in particular can be rated as environmentally friendly.

Accordingly, the state of the art still lacks methods for dyeing leather which consume little or only small amounts of water as well as colorants and at the same time achieve a high efficiency, for example with regard to dye consumption as well as waste quantities.

The object of the present invention is therefore to provide a method for dyeing leather, wherein the problems and disadvantages described above in connection with the prior art are to be largely avoided or at least mitigated.

In particular, it is an object of the present invention to provide a method for dyeing leather that uses only little or, in particular, virtually no water as a process medium, so that water consumption during the dyeing of leather can be significantly reduced.

Likewise, an object of the present invention is to provide a method for dyeing leather that requires only comparatively small amounts of colorant and at the same time achieves a high dye consumption, so that in particular only small amounts of waste colorant are produced and dyeing of leather is achieved in a comparatively environmentally friendly manner.

It goes without saying that particular features, characteristics, embodiments and advantages or the like which are set forth hereinafter—for the purpose of avoiding unnecessary repetition—with respect to only one aspect of the invention, shall of course apply analogously with respect to the remaining aspects of the invention, without the need for express mention thereof.

In addition, it applies that all value or parameter data or the like mentioned in the following can in principle be measured or determined with standardized or explicitly stated determination methods or with measurement methods familiar to the person skilled in the art in this field.

Furthermore, it goes without saying that all weight- or quantity-related percentages are selected by the person skilled in the art in such a way that the total results in 100%; however, this goes without saying.

With this proviso stated, the present invention will be described in more detail below.

Subject-matter of the present invention—according to a first aspect of the present invention—is a method for dyeing leather, in particular for producing a dyeing with a high rub fastness, with an organic colorant in a supercritical fluid, wherein in a first method step (a) the surface of the leather is coated, and in a second method step (b) following the first method step (a), the coated surface of the leather is dyed with the organic colorant in the supercritical fluid.

Surprisingly, it has been shown that with the method according to the invention a dyed leather can be obtained in an efficient manner, which in particular is characterized by a high rub fastness, determined according to DIN EN ISO 11640 and ISO 105-A02. In this respect, the rub fastness of dyed leathers according to the invention or leathers dyed according to the method according to the invention clearly exceeds the rub fastness of conventionally dyed leathers. For example, conventionally dyed leathers rarely comprise values above 3 for measurements of rub fastness according to DIN EN ISO 11640 on a measurement or grading scale of 1 to 5. In contrast, leathers dyed according to the method of the invention usually achieve values or scores of more than 4 on the measurement scale of 1 to 5. Conventional dyed leathers usually have to be coated with a further protective layer in order to achieve such high rub fastness properties. In particular, on the other hand, a special feature of the present invention is that the dyed leathers or leather products comprise a high rub fastness and, at the same time, the application of a transparent top layer or varnish layer to the dyed leather surface can be dispensed with.

Furthermore, it is a significant advantage of the present invention that the method according to the invention, in particular the second method step (b) of the method according to the invention, in which the actual dyeing of the leather takes place, is carried out in a supercritical fluid. Thus, in particular, the use of water as a process medium can be at least substantially dispensed with. This results in a particular advantage over conventional methods for dyeing leather, in particular with regard to environmental protection aspects. Within the scope of the present invention, it is possible to dispense with dye liquors containing color and additives and with the costly cleaning of wastewater contaminated with colorants, for example, as is the case for conventional leather dyeing processes. This aspect furthermore holds a great potential for cost savings, so that the method according to the invention can also be evaluated as positive or advantageous from an economic point of view.

A further significant advantage of the present invention, in particular of the method according to the invention, can also be seen in the fact that the method according to the invention can achieve a particularly high efficiency with respect to the consumption of the colorants used. In particular, within the scope of the method according to the invention, it is possible to drastically reduce the amount of colorant used compared to conventional dyeing processes and, at the same time, to significantly increase the consumption of the colorant used. This is in particular due to the dyeing of leather in the supercritical fluid, which in particular also serves as a solvent or dispersant for the colorant used.

The term consumption is usually understood to mean the ratio of chemicals used, e.g. colorants, to chemicals not enriched or fixed in the leather. In conventional water-based leather dyeing, for example, a dye consumption of 50% means that half of the total dye used is absorbed by the leather, while the other half has to be disposed of with the wastewater.

The high dyeing efficiency or dye consumption of the method according to the invention can be achieved in particular by impregnating the leather uniformly with the colorant on its surface, i.e. the grain side of the leather, wherein the parameters of the method according to the invention are preferably selected in such a way that the colorant used comprises only a low solubility in the supercritical fluid and in particular in relation thereto a high affinity or solubility in the surface of the leather, in particular the coating of the leather. On this basis, it can be achieved that the colorant diffuses or penetrates into the coating so that the latter is impregnated with the colorant in particular up to or almost up to the solubility limit of the colorant in the coated surface of the leather.

Based on the high dye consumption, it can further be achieved that only very small amounts of excess colorant are produced, which can be separated or collected and recycled in an uncomplicated manner. In particular, the amount of colorant used can be adjusted as a function of the leather surface to be dyed so that only an almost negligible excess of colorant results. The method according to the invention is to be regarded as highly efficient, since it permits optimum utilization of the quantities of colorant used, so that excellent dyeing results can be achieved with comparatively small quantities of colorant used. In addition, downstream of the method according to the invention, cleaning of the apparatus in which the method according to the invention is carried out, which is in particular time-consuming, can be dispensed with to the greatest possible extent. In particular, it may also be the case that the apparatus in which the method according to the invention is carried out can be purified with less effort than is required in the context of conventional dyeing processes, so that the method according to the invention can also be classified as time-saving or time-efficient.

Furthermore, the method according to the invention can be carried out with a wide range of colorants, wherein superior dyeing results can be obtained in particular with respect to the rub fastness of the dyeing obtained compared to conventional methods. The colorants suitable or used according to the present invention differ significantly from the colorants used in conventional methods for dyeing leather. In particular, hydrophobic or non-polar colorants are preferred within the scope of the present invention, which can furthermore be used free of actuating agents or in pure form. These colorants are not or cannot be used in conventional leather dyeing, but are usually used in lacquers or for dyeing oils. In this way, the method according to the present invention thus in particular also opens up new ways or comparatively uncomplicated possibilities with regard to the use of colorants which hitherto cannot be used for dyeing leather or can only be used in dyeing compositions which are difficult to formulate.

In accordance with a further advantage of the present invention, it is furthermore entirely sufficient within the scope of the method according to the invention for a very good dyeing result if the colorants used are presented in a reactor, in particular an autoclave, in solid or liquid, preferably solid, form or are dissolved or dispersed in the supercritical fluid only to a small extent during the dyeing step.

In particular, a rather low solubility or dispersibility of the colorant in the supercritical fluid does not represent a disadvantage for the method according to the invention. On the contrary, an only low solubility or dispersibility of the colorant used in the super-critical fluid is preferred within the scope of the invention, since in this way it can be achieved that only the low portion of the colorant dissolved or finely dispersed in the supercritical fluid diffuses into the surface of the leather, which comprises a coating, so that the leather surface is impregnated with the colorant as a result. In this way, it can be achieved that the amount or concentration of the colorant dissolved or finely dispersed in the supercritical fluid is reduced, since the colorant diffuses into the coated leather surface, in which the colorant preferably comprises a higher solubility, and thus successively impregnates it. At the same time, further colorant is finely dispersed or dissolved in the supercritical fluid in the autoclave, so that a high loading of the leather surface or, in particular of the coating of the leather, with the colorant can be ensured. The equilibrium shifts underlying these processes, and in particular the dissolution or dispersion processes of the colorant in the supercritical fluid or in the coated surface of the leather, preferably take place almost instantaneously under the process conditions according to the invention, i.e. at a speed in the sub-second range.

In the context of the present invention, an, in particular fine, dispersion is to be understood as an at least two-phase system, wherein a first phase, i.e. the dispersed phase, is present distributed in a second phase, the continuous phase. The continuous phase is also referred to as the dispersion medium or dispersant, in particular wherein the supercritical fluid serves as the dispersant according to the invention; the continuous phase is usually present in the form of the dissolved or finely dispersed, i.e. finely distributed, colorant in the context of the present invention, and dispersions are generally liquid-in-liquid or solid-in-liquid dispersions in the context of the present invention. In particular, the transition of the colorant in the supercritical fluid from a solution to a dispersion may be fluid and a clear distinction between a solution and a dispersion cannot always be made.

With regard to the portion of the colorant that is not finely dispersed or dissolved, it can be effected that the colorant is gradually dissolved or finely dispersed in the supercritical fluid, so that the portion of the colorant that is not deposited or incorporated in or on the surface or, in particular the coating, of the leather, is continuously reduced over the duration of the method according to the invention, wherein a homogeneous and uniform dyeing of the leather on the coated surface can likewise be achieved. Thus, this particular dyeing mechanism allows in particular that only the amount of dye required for the dyeing of the leather section to be dyed in the method according to the invention needs to be used.

The solubility or dispersibility of the dye in the supercritical fluid depends in particular on the process parameters of pressure and temperature, wherein, for example, in the case of common azo, anthraquinone or mordant dispersion dyes, this lies between 10-4 and 10-7 mol of dye per mol of CO2. The dye uptake capacity of the coatings, on the other hand, can be many powers higher, in particular depending on the composition of the coating, so that an almost 100 percent dye consumption can be achieved with the method according to the invention, in particular if the free volume, i.e. the volume in which no leather is present, in the apparatus or reactor, in particular the autoclave, is as low as possible.

A reduction of the free volume may be limited by the fact that the leathers to be dyed may not be continuously covered during dyeing. In the case of reactor filling, in which several leathers lie on top of each other as a bulk, this can be avoided by rotating and mixing the samples during the dyeing process. Alternatively, the leathers can be fixed in devices that ensure a distance between the leather sections.

Thus, the method according to the present invention is characterized overall by an efficiency which is in particular high with respect to dye consumption, as well as a process management which can be judged as advantageous from an environmental point of view, in that, for example, the use of water as a process medium can be dispensed with and the quantities of waste produced can be maximally kept low.

It is preferred in the context of the present invention if exclusively the coated surface, in particular the coating, of the leather is dyed.

Now, with regard to the leather which is preferably used or employed within the scope of the present invention or, in particular, within the scope of the method according to the invention, these are generally common leathers. These leathers may be suitable or used, for example, for leathering and/or furnishing of vehicle, aircraft, ship and/or boat interiors, and may also be intended for use in the textile and furniture sector, for bags, backpacks, and all types of luggage, as well as in the decorative, accessory and life-style sectors. Suitable for carrying out the method according to the invention are in principle all types of leather. Exemplary leathers may thus be selected from the group of cow leather, goat leather, sheep leather, ostrich leather, pig leather, suede leather and/or reptile leather.

In this regard, a particular advantage of the present invention can also be seen in the fact that the leather itself is in particular not dyed, but the dyeing is exclusively supplied to the coated surface, in particular the coating on the surface of the leather. In this way, for example, it can be ensured in an uncomplicated and reliable manner that in particular the flesh side of the leather, i.e. the underside or, in the case of the animal, the inner skin side of the leather, is not dyed, so that as a result the amount of colorant used can be kept comparatively low and only the desired, i.e. coated, areas of a leather section are dyed in a targeted manner.

Therefore, the method according to the invention in particular also offers the advantageous possibility that, for example, coated surfaces and non-coated surfaces can be present next to each other in a leather section, wherein in the dyeing process according to the invention only the coated leather section of the leather is dyed in a targeted manner. In this way, for example, patterns or a different color design can be realized within a leather section in an uncomplicated manner without having to take particularly elaborate preparatory measures for this purpose.

With regard to the coating of the surface of the leather, it has in particular been well proven in the context of the present invention if the surface of the leather is or is coated with a coating agent, in particular an organically based coating agent, preferably a varnish, preferably a polymer varnish.

In this sense, it is equally preferentially provided that in method step (a) an, in particular organically based, coating agent, preferably a varnish, more preferably a polymer varnish, is applied to the surface of the leather.

In the context of the present invention, an organically based coating agent is understood to mean in particular a coating agent which contains at least one organic binding agent, in particular consists thereof. According to the present invention, an organic binding agent preferably comprises monomeric, oligomeric or polymeric compounds of carbon.

With regard to the application of the coating, it is further preferentially provided in the context of the present invention that the, in particular organically based, coating agent, in particular the varnish, preferably the polymer varnish, is applied to the surface of the leather in a plurality of layers.

In this context, it has been well proven in the context of the present invention if the, in particular organically based, coating agent is applied in 4 to 10, in particular 5 to 9, layers.

Likewise, in the context of the present invention, particularly good results are obtained if the, in particular organically based, coating agent, is applied in 4 to 10, in particular 5 to 9, coating or application passes.

In this context, it has further proved advantageous if the, in particular organically based, coating agent, in particular the paint, preferably the polymeric paint, is applied in the form of a primer and a topcoat.

In this context, according to the invention, it is usually provided that the primer comprises a higher layer thickness or in particular more layers than the topcoat, wherein the layer thickness or the number of layers of the primer can be adjusted as required. In the context of the present invention, higher layer thicknesses in particular have been found to be advantageous with respect to the primer, since in particular the higher the layer thickness of the primer, the more intense colorations can be achieved. However, depending on the use of the dyed leather, a thinner primer may also be preferred, in particular if the dyed leather is to give as natural an impression as possible in terms of feel and appearance.

In the context of the present invention, the topcoat is usually configured with a lower layer thickness or lower number of layers. In this context, it may be the case, for example, that the topcoat is applied in two layers to the underlying primer, which may comprise, for example, 2 to 8 layers.

With regard to the composition of the, in particular organically based, coating agent, it is now usually envisaged that coating components or coating compositions which are commonly used in the leather industry find use in the context of the present invention. In particular, it has been well proven if the, in particular organically based, coating agent, in particular the lacquer, preferably the polymer lacquer, comprises organic polymers, in particular as binding agents, preferably is consisting thereof.

In this context, particularly good results are obtained in the context of the present invention if the, in particular organically based, coating composition comprises polymers selected from the group consisting of polyurethane, polyacrylate, butadiene co-polymer, vinylidene chloride copolymer and/or mixtures thereof, preferably polyurethane, in particular consisting thereof.

In this context, it has been shown in particular that the more amorphous the polymer used, the better the results obtained for the method according to the invention. In the context of the present invention, an amorphous polymer is understood to mean polymers which comprise predominantly disordered segments, for example in the form of segments of long carbon chains.

With regard to the polyurethane preferred in accordance with the present invention, amorphous polyurethane is also referred to as soft polyurethane. If soft or amorphous polyurethane, in particular with a high polyol content, is now used in the coating compositions according to the invention, in particular organically based ones, or preferably coatings, preferably polymer coatings, particularly good coloring results are obtained in the method according to the invention. Likewise, particularly good results with regard to the dyeing of leather or with regard to the color of the leather obtained can be obtained for blends of polyurethane with polyacrylate. The use of exclusively pure acrylates, on the other hand, is less preferred in the context of the present invention.

It has also proved advantageous in the context of the present invention if the, in particular organically based, coating agent also contains further additives, such as, for example, in particular defoaming agents.

As far as the application of the, in particular organically based, coating agent, in particular the varnish, preferably the polymer varnish, to the surface of the leather is concerned, this can generally be carried out using the means or measures familiar to the skilled person. It has been particularly well proven in the context of the present invention if the, in particular organically based, coating agent is applied to the surface of the leather by means of spraying, sputtering, rolling or casting, in particular spraying or sputtering.

Now, with regard to the coating agent amounts which have proven suitable for coating the surface of the leather in the context of the method according to the present invention, these can generally vary within wide ranges, in particular depending on the use of the dyed leather or the requirements placed on the dyed leather.

In this regard, it has been well proven in the context of the present invention if the, in particular organically based, coating agent is applied in amounts of more than 2 g/ft2, in particular 8 g/ft2, preferably 9 g/ft2, preferably 10 g/ft2, based on the total amount of coating agent.

Likewise, it is preferred if the, in particular organically based, coating agent is applied in amounts of less than 50 g/ft2, in particular 20 g/ft2, preferably 19 g/ft2, preferably 18 g/ft2, based on the total amount of coating agent.

Finally, in a preferred embodiment of the present invention, it may be provided that the, in particular organically based, coating agent is applied in amounts of 2 to 50 g/ft2, in particular 8 to 20 g/ft2, preferably 9 to 19 g/ft2, preferably 10 to 18 g/ft2, based on the total amount of coating agent.

Likewise, it has been found to be preferential if the, in particular organically based, coating agent is applied with a layer thickness in a range of more than 2 ∞m, in particular 3 ∞m, preferably 4 ∞m, preferably 5 ∞m, based on the total layer thickness of the coating agent.

Furthermore, in accordance with the invention, it can preferably be provided that the, in particular organically based, coating agent is applied with a layer thickness in a range of less than 750 ∞m, in particular 200 ∞m, preferably 100 ∞m, preferably 50 ∞m, further preferably 25 ∞m, based on the total layer thickness of the coating agent.

In a preferred embodiment of the present invention, it has proved advantageous if the, in particular organically based, coating agent is applied with a layer thickness in a range from 2 to 750 μm, in particular 2 to 200 μm, preferably 3 to 100 μm, preferably 4 to 50 μm, further preferably 5 to 25 μm, based on the total layer thickness of the coating agent.

In the context of a preferred embodiment of the present invention, it may be provided that the coating of the surface of the leather is a finish.

Here, the term finish describes in particular a refinement of the tanned leather, with which in particular also required surface properties are adjusted. The finish thus preferentially improves the visual impression and usability of the finished leather products. Finishing can make leather less sensitive to moisture and more permeable to water, and can increase light-fastness and reduce the need for and expense of cleaning.

With regard to the quality of the leather, it has also proved well in accordance with the invention if the leather is tanned in advance of the method, in particular in a step preceding the first method step (a), preferably in a preceding method step or a preceding method.

In this respect, it is preferred within the scope of the method according to the invention if the leather is not dyed and/or coated preceding to the method, in particular preceding the first method step (a).

Within the scope of the method according to the invention, it is thus preferentially provided that the used, in particular tanned, leathers do not obtain any dyeing or pre-treatment in the form of a coating of the surface, i.e. the skin side, of the leather in advance of the method according to the invention.

As far as the second method step (b) is concerned, this step usually involves dyeing the surface of the leather coated in method step (a) with the organic colorant in the supercritical fluid.

A significant advantage of the method according to the invention, in particular with regard to the sequence or performance of the method steps (a) and (b), now also consists in particular in the fact that the method steps can be performed both directly in succession and also offset in time from each other. Thus, according to the invention, it is in particular also possible to coat the surface of the leather first, according to method step (a), and to carry out the subsequent dyeing step according to method step (b) at a later point in time, independent of the first method step (a). Accordingly, it is also possible, for example, for the leather to be coated by an external manufacturer, supplier or contract manufacturer and to be provided as such for the method according to the invention and then to be used further. In particular, this is not expected to have any disadvantages for the dyeing result in method step (b).

With regard to the organic colorant, it has been proven well in accordance with the invention if the organic colorant is a dye or a mixture of dyes.

In the context of the present invention, a dye is understood to be a colorant that is generally soluble in a solvent or also in water. Many organic dyes are readily soluble in organic solvents, although the use of organic solvents in leather dyeing processes is not preferred or usually not envisaged. Aqueous solutions of organic dyestuffs are usually produced with the addition of, for example, dispersing agents, actuators, emulsifiers, stabilizers and similar or further additives and can be used as such in the leather industry, wherein, however, both the formulation of such dyeing liquors and in particular the disposal thereof are costly.

In the context of the method according to the present invention, it is a particular advantage that—irrespective of the fundamental solubility of the organic colorants in water or a solvent—it is not fundamentally intended or desired for the method according to the present invention that the organic colorant, in particular the dye, be completely dissolved in the process medium. Rather, it is even preferred in the context of the present invention if the organic colorant, in particular the dye, is present in the supercritical fluid predominantly in solid or particulate form, and only to a small extent dissolved or finely dispersed in the supercritical fluid.

In this context, an advantage of the method according to the invention is in particular also to be seen in the fact that mixtures of several colorants can be used and from these mixtures an evenly and uniformly colored leather can be obtained, which in particular comprises the mixed color shade of the mixed colorants used which is usually expected, i.e. in conventional methods.

This is noteworthy because, as previously stated, in the context of the present invention it is not essential that the organic colorant, in particular the dye, is present, in particular almost completely, dissolved in the supercritical fluid as is required for conventional methods. Rather, according to the invention, it has proved advantageous if the organic colorant, in particular the dye, is present in the supercritical fluid predominantly dispersed or distributed in particulate solid form in the supercritical fluid.

Accordingly, it may have been expected, in particular for dye mixtures, that a non-uniform dyeing result is obtained on the leather, since the individual dyes are predominantly present next to each other in the mixture and, in particular, may go into solution in the supercritical fluid in different, i.e. more or less, small proportions, so that a non-uniform dye mixture or a varying hue could have been expected. However, this is not the case in the method according to the invention. Even when using mixtures of colorants, a uniform and homogeneous dyeing of the leather with the accordingly mixed shade of the colorants is obtained. In this case, within the scope of the method according to the invention, in particular a hue or in particular also a mixed hue is obtained which corresponds to the expected or conventional hue of this colorant or color mixture.

Now, as far as the selection of the colorant is concerned, this can be selected from a large number of organic colorants, in particular wherein the colorants or in particular dyes preferred according to the present invention, however, differ significantly from the colorants used in the context of conventional methods for dyeing leather. In particular hydrophobic and/or nonpolar colorants or in particular dyes are preferred within the scope of the present invention, which furthermore are preferably used free of actuating agents or in pure form. These colorants can usually be used, for example, in paints or for coloring oils.

It has also been well proven in the context of the present invention if the dye is in particular at least substantially soluble in the supercritical fluid, preferably in supercritical carbon dioxide.

In accordance with the present invention, it is thereby preferred if the dye is selected from the group consisting of, in particular actuator-free, disperse dyes, solvent dyes, food dyes, pigments and mixtures thereof, preferably, in particular, actuator-free disperse dyes, solvent dyes and mixtures thereof.

For example, particularly good results are obtained in the method according to the invention if the dye is selected, for example, from dyes from the group of C.I. Disperse Orange, C.I. Disperse Blue, C.I. Disperse Red, C.I. Solvent Yellow, C.I. Solvent Red, C.I. Solvent Blue, C.I. Solvent Black, carotenoids, anthocyanin, betanin, turmeric, and mixtures thereof. In general, however, the method according to the invention is particularly flexible and versatile such that generally all organic colorants, in particular dyes, are suitable, provided that the organic colorant, in particular the dye, comprises an at least minimal solubility or dispersibility in the supercritical fluid.

In the method according to the invention, it is further preferred if the organic colorant, in particular the dye, is used in powdery form and/or as a solution, in particular in powdery form.

In the event that the organic colorant, in particular the dye, is used as a solution, it is usually provided in the context of the present invention that a solution of the organic colorant, in particular dye, in an organic solvent and/or water is used. The organic solvent may be selected from in particular volatile solvents, such as methanol, ethanol, dichloromethane, acetone, and mixtures thereof. In general, however, it is preferred in the method according to the invention if the organic colorant, in particular the dye, is used in powdery form.

A particular advantage of the method according to the invention can therefore be seen in the fact that in particular, for example, disperse colorants, which—if at all possible or suitable for this purpose—can only be supplied in color solutions as pure substances, i.e. in particular in the form of pure powders, within the framework of conventional dyeing processes for leather with the aid of stabilizers, adjusting agents, emulsifiers and similar additives. This applies equally to the other above-mentioned dye classes. In this way, it can be achieved that the method according to the invention in particular can be carried out almost completely without additional solvents or water as well as possible solubilizing additives.

Now, as far as the supercritical fluid in the presence of which the leather is dyed with the colorant is concerned, it is generally provided for the latter that the supercritical fluid is obtained from a substance which is gaseous and/or liquid under normal conditions, in particular from a substance which is gaseous under normal conditions, by admission of the substance to pressure and temperature.

Accordingly, in the context of the present invention, a supercritical fluid is understood in particular as a substance which is converted into the supercritical state of aggregation and in this state of aggregation comprises properties, in particular fluid properties, wherein these properties lie between the properties which this substance comprises in the gaseous or liquid state of aggregation. In particular, the supercritical fluid has a density comparable to the density that this substance has in the liquid aggregate state and a viscosity that is in accordance to the viscosity that the substance has in the gaseous aggregate state.

In this respect, it has been particularly well proven in the context of the present invention if the supercritical fluid is obtained from carbon dioxide, in particular is super-critical carbon dioxide.

Furthermore, in the context of the present invention, it is usually provided that the supercritical fluid is generated in an apparatus which can be subjected to pressure and temperature, in particular an autoclave.

Accordingly, it has been found to be particularly advantageous for method step (b) if the second method step (b) is carried out with admission of pressure and/or temperature.

Likewise, it can be provided that the second method step (b) is carried out in an apparatus, preferably an autoclave, to which pressure and temperature can be applied.

With regard to the process conditions and parameters under which the method according to the present invention is carried out, these can vary within a wide range. However, good results are obtained in the context of the present invention in particular if the second method step (b) is carried out at a pressure of more than 70 bar, in particular 80 bar, preferably 90 bar, more preferably 95 bar.

Now, as far as the upper limit of possible or suitable pressure ranges is concerned, it has been shown in the context of the present invention that intensive and qualitatively satisfactory dyeing results can still be obtained at a pressure in a range of up to 300 bar, in particular 250 bar, in particular wherein, however, higher amounts of colorant are required for this purpose. It has therefore proved particularly advantageous and preferable if the second method step (b) is carried out at a pressure of less than 130 bar, in particular 120 bar, preferably 110 bar, more preferably 105 bar.

Finally, it is even more preferred if the second method step (b) is carried out at a pressure in a range from 70 to 130 bar, in particular 80 to 120 bar, preferably 90 to 110 bar, more preferably 95 to 105 bar.

Finally, in the context of an even more preferred embodiment of the present invention, it has proven to be advantageous if the second method step (b) is carried out at a pressure of 100 bar.

With regard to the temperatures used in the method according to the present invention, it has proved advantageous if the second method step (b) is carried out at temperatures above 31° C., in particular 34° C., preferably 37° C., more preferably 39° C.

Likewise, particularly good results are obtained in the method according to the invention if the second method step (b) is carried out at temperatures of less than 80° C., in particular 60° C., preferably 50° C., more preferably 45° C.

It has thus been found to be advantageous if the second method step (b) is carried out at temperatures in a range from 31 to 80° C., in particular 34 to 60° C., preferably 37 to 50° C., more preferably 39 to 45° C.

Finally, particularly good results are obtained within the scope of a preferred embodiment of the method according to the invention if the second method step (b) is carried out at a temperature of 40° C.

Now, with regard to the mode of action of the method according to the invention or the dyeing principle on which the method according to the invention is based, it has proved advantageous for the method according to the invention—as has already been mentioned at the outset—in particular if, in the second method step (b), the dyeing of the coated surface of the leather is carried out by impregnating the coated surface, in particular the coating, with the organic colorant.

In the context of the present invention, impregnation of the coated surface, in particular the coating, of the leather is understood to mean that the portion of the organic colorant, in particular dye, dissolved or dispersed in the supercritical fluid is impregnated into the coated surface, in particular the coating, of the leather, in particular the coating, of the leather and adsorbs there, wherein this process is based in particular on a higher solubility or affinity of the colorant for the coated surface of the leather, so that the latter is penetrated or saturated with the organic colorant, in particular the dye. In this way, it can be achieved that only the coating, which is applied to the upper side or grain side of the leather, is colored, while the leather itself does not absorb any colorant. In this way, a full-surface uniform and homogeneous coloring of the leather can be achieved within the scope of the present invention in a very efficient manner and in particular by using only small amounts of colorant.

In this regard, it is preferred in particular in the context of the present invention if the coated surface of the leather, in particular the coating, is impregnated with the organic colorant uniformly, preferably over the entire layer thickness of the coating.

On this basis, it becomes possible in particular in the context of the present invention that by impregnating the coated surface, in particular the coating, with the organic colorant, a high rub fastness is achieved, in particular with a grade in a range of 4 or more, preferably 4.5 or more, determined according to ISO 11640:2012 and ISO 105 A03.

In this context, it is a particular advantage of the method according to the invention that no colorant layer, for example only superficially, is applied or deposited on the coated surface, in particular the coating, of the leather, but that a coloration penetrating or impregnating the coated surface, in particular coating, of the leather can be achieved. In particular, the organic colorant, preferably the dye, can penetrate deeply into the coated surface, in particular the coating, of the leather in order to then be adsorbed or fixed and incorporated there, so that rubbing off or similar mechanical removal of the dye from the leather surface cannot take place. This is a particular advantage of the method according to the invention or of the leather coated according to the method according to the invention compared to conventionally dyed leathers, which usually cannot achieve the high rub fastnesses observed according to the invention.

Consequently, it has proved advantageous in the method according to the invention if in method step (b) the organic colorant is dissolved and/or dispersed in the supercritical fluid.

In this sense, therefore, it may be envisaged that the supercritical fluid serves as a, in particular non-polar, solvent and/or dispersant.

With regard to the quantities in which the organic colorant, in particular the dye, is used in the method according to the present invention, these are usually comparatively small compared with conventional methods. In particular, especially good results are obtained in the context of the present invention if in method step (b) the organic colorant is used in amounts of from 0.01 to 0.75 g/ft2, in particular from 0.025 to 0.6 g/ft2, preferably from 0.05 to 0.4 g/ft2, based on the area of the leather.

Likewise, it may be preferentially provided in the method according to the invention that in method step (b) the organic colorant is used in amounts from 0.1 to 2 mmol/ft2, in particular 0.25 to 1.75 mmol/ft2, preferably 0.4 to 1.6 mmol/ft2, based on the area of the leather.

Particularly good results are obtained in the context of the present invention if, in method step (b), the organic colorant comprises a solubility in the supercritical fluid in a range of 10-3 to 10-8 mol/mol (supercritical fluid), in particular 10-4 to 10-7 mol/mol (supercritical fluid), based on the molar amount of the supercritical fluid.

Thus, in accordance with the invention—as has already been mentioned—it is preferably provided that the organic colorant, in particular the dye, comprises a comparatively low solubility or dispersibility in the supercritical fluid, i.e. is present predominantly in particulate solid form, and is dissolved or dispersed in the supercritical fluid only to a very small extent.

Here, for the above-mentioned value ranges or value specifications, it is provided in particular that the volume and/or the molar amount of the supercritical fluid is/are dependent on the pressures and temperatures set in method step (b), in particular wherein the pressure is set in a range of from 70 to 130 bar, in particular from 80 to 120 bar, preferably from 90 to 110 bar, more preferably from 95 to 105 bar, and the temperature is set in a range of from 31 to 80° C., in particular from 34 to 60° C., preferably from 37 to 50° C., more preferably from 39 to 45° C.

In the method according to the invention, the amounts or ratios of the organic colorant to leather surface area or amount of supercritical fluid are now preferably selected so that the organic colorant comprises a higher solubility in the coated surface, in particular the coating, of the leather than in the supercritical fluid at the pressures and temperatures set in method step (b).

In this context, it has been found to be particularly advantageous if the solubility of the organic colorant in the coated surface, in particular the coating, of the leather is more than 10 times, in particular more than 100 times, preferably more than 1000 times, preferably more than 10,000 times, as high as in the supercritical fluid.

Likewise, it is preferred according to the invention if the solubility of the organic colorant in the coated surface, in particular the coating, of the leather in relation to the supercritical fluid is shifted to the side of the coated surface, in particular the coating, of the leather by the pressures and temperatures set in method step (b), in particular is almost completely on the side of the coated surface, in particular the coating, of the leather.

In this way, it can be advantageously ensured that in the method according to the invention, in particular, almost exactly only those amounts of organic colorant, in particular dye, need to be used which can also diffuse into or impregnate the coated surface of the leather, in particular the coating of the leather.

In particular, the method according to the invention is designed in such a way that only the part of the organic colorant dissolved or finely dispersed in the supercritical fluid penetrates or impregnates the coated surface, in particular the coating, of the leather, in order then to be fixed in it or to adsorb there. The result is that constantly dissolved or dispersed, in particular dissolved, organic colorant is removed from the solubility equilibrium between the colorant dissolved or dispersed in the supercritical fluid and the particulate solid of the colorant by enriching dissolved or dispersed, in particular dissolved, colorant in the coated surface, in particular coating, of the leather.

Thereupon, colorant can gradually continue to pass from the solid into solution or dispersion until the solubility limit or dispersion limit of the organic colorant in the coated surface, in particular coating, of the leather is reached.

On the basis of this process principle or dyeing mechanism, a particularly high dye consumption can be achieved, since in particular hardly any dissolved or dispersed dye is present in the supercritical fluid, but rather in particular almost the entire dissolved or finely dispersed part of the dye diffuses into the coated surface, in particular coating, of the leather and remains there. The absorption or solubility limit of the organic colorant in the coated surface, in particular coating, of the leather is thereby in the range of the above-mentioned amounts or concentrations for the colorant in relation to the area of the leather to be dyed and in particular taking into account the volume of the supercritical fluid.

In this context, it is advantageous in particular that the amounts of colorant required in the method according to the invention can be specifically adjusted or calculated to the area of leather to be dyed, so that the use of, in particular, high excess amounts of colorant can be avoided. In this way, in addition to efficient use of colorant, it can also be ensured that no excess colorant is deposited on the leather surface and thus, for example, the rub fastness of the dyed leather is negatively affected.

Now, with regard to the duration over which the method according to the invention is carried out, it has proved particularly advantageous in the context of the present invention if in method step (b) the coated surface of the leather is dyed with the color for a duration of 0.2 to 180 min, in particular 0.5 to 150 min, preferably 1 to 120 min. The above-mentioned ranges or process durations for the method according to the invention in general refer in particular to the time or duration over which pressure and/or temperature, at which the method according to the invention is carried out, are set or maintained constant. Thus, in particular, the duration for pressure and/or temperature buildup or reduction are not included in the above-mentioned ranges, in particular also since these may vary depending on the apparatus used, in particular the autoclave. In this sense, according to the invention, the process duration can also be understood as the pressure or temperature holding duration.

According to the invention, the duration of the method can thereby be influenced in particular by the way in which the leather is provided, in particular wherein the duration of the method can be set to be shorter the more freely accessible the surfaces, i.e. in particular the coated surface, of the leather are. If, for example, the leather is supplied fixed in a holding device to the apparatus, in particular the autoclave, in which the method according to the invention is carried out, in such a way that the coated surface of the leather is freely accessible and uncovered, the duration of the method can be reduced to a few seconds or minutes, in particular since the impregnation process of the leather surface with the colorant takes place almost instantaneously at the pressures or temperatures preferably provided according to the invention. In this case, for example, particularly good results can be obtained if in method step (b) the coated surface of the leather is dyed with the colorant over a period of 0.2 to 30 min, in particular 0.5 to 10 min, preferably 1 to 5 min.

Likewise, it is also possible and good results are obtained in the method according to the invention if the leather is provided as loose filling. In this case, it has been well proven if the leather is moved in the apparatus, in particular rotated, so that the coated surface of the leather is or becomes accessible. The impregnation process itself, as previously described, preferably proceeds almost instantaneously. To ensure a high-quality dyeing result, it can nevertheless be advantageous if the process duration for loose leather piles is increased somewhat, so that all areas of the coated surface come into contact with the colorant and can be dyed. In this case, it has been found advantageous if in method step (b) the coated surface of the leather is dyed with the colorant for a duration of 5 to 180 min, in particular 10 to 150 min, preferably 30 to 120 min.

After this duration in method step (b) has elapsed, the pressure or temperature set in the method according to the invention, in particular the pressure, is then reduced stepwise, preferably at a relaxation rate of 1 to 5 bar/min, to normal conditions. During this process, the supercritical fluid also returns to its normal state or its state at normal conditions, i.e., in particular preferentially returns to the gaseous state. Thereupon, the leather dyed according to the invention or a leather that has been dyed according to the method according to the invention can be obtained, in particular without requiring, for example, further post-treatment steps, such as the application of a final or sealing coating.

Further subject-matter of the present invention—according to a second aspect of the present invention—is the use of a method for dyeing leather, in particular according to the invention, for producing dyed leather having a rub fastness RFT with a grade in a range of 4 or more, determined according to ISO 11640:2012 and ISO 105 A03.

For further details on the use according to the present invention, reference may be made to the above explanations on the method according to the present invention, which apply accordingly with respect to the use according to the present invention.

Another subject-matter of the present invention—according to a third aspect of the present invention—is a dyed leather, in particular obtainable according to the method according to the present invention, having a rub fastness RFT with a score in a range of 4 or more, determined according to ISO 11640:2012 and ISO 105 A03.

In particular, it is preferred in the context of the present invention if the leather comprises a rub fastness RFT with a grade in a range of 4 to 5, in particular 4.5 to 5, determined according to ISO 11640:2012 and ISO 105 A03.

In this context, it is preferentially provided that the leather comprises a coating on the surface, in particular the skin side. In this sense, in the context of the present invention, with respect to the leather, it is preferably a coated leather.

In this respect, it has been particularly well proven in accordance with the present invention if the coating comprises a plurality of layers, in particular a primer and a top layer.

Furthermore, it may preferably be provided that the coating comprises, in particular consists of, an organically based coating agent, preferably a varnish, preferably a polymer varnish.

In this context, it has been particularly well proven according to the invention if the, in particular organically based, coating agent, in particular the varnish, preferably the polymer varnish, contains polymers selected from the group consisting of polyurethane, polyacrylate, butadiene copolymer, vinylidene chloride copolymer and/or mixtures thereof, preferably polyurethane, in particular consists thereof.

Particularly good results are obtained in this context if the coating comprises a layer thickness in a range from 2 to 750 μm, in particular 2 to 200 ∞m, preferably 3 to 100 μm, preferably 4 to 50 μm, further preferably 5 to 25 μm.

In this context, "coated leather" usually refers to leather that comprises a coating with a layer thickness of more than 150 μm, for example based on coatings with binding agents, films or foams. However, a material is generally neither "leather" nor "coated leather" if the layer thickness of the coating is more than one third of the total thickness of the coated leather. Accordingly, in particular patent leathers, which typically comprise coatings having high layer thicknesses, are considered to be leather if the coating does not exceed one-third of the total thickness of the patent leather.

In the context of the present invention, the preferred layer thicknesses for the coating, in particular depending on the intended use of the leather, can now both be less than 150 μm and lie in the range of patent leather, in particular wherein, however, it is ensured that the layer thickness of the coating does not exceed one third of the total thickness of the coated leather. According to the invention, a coated leather is thus understood to comprise, in addition to e.g. patent leather, in particular also such a leather which comprises a coating with a layer thickness of less than 150 μm, i.e. only a, in particular very, thin coating, preferably with layer thicknesses in the range of a few micrometers.

It is further particularly preferred in accordance with the invention if only the coated surface, in particular the coating, of the leather is colored.

In this context, it has been well proven in particular if the leather is dyed, in particular impregnated, with an organic colorant, in particular a dye, preferably selected from the group consisting of disperse dyes, solvent dyes, food dyes and mixtures thereof, preferably disperse dyes, solvent dyes and mixtures thereof.

For further details on the dyed leather, reference can be made to the above explanations on the other aspects of the invention, which apply accordingly with respect to the dyed leather.

Further subject-matter of the present invention—according to a fourth aspect of the present invention—is a product, in particular leather product and/or leather goods, preferably for use in the leathering and/or furnishing of vehicle, aircraft, ship and/or boat interiors, for bags, backpacks and/or luggage and/or in the textile, decor, accessory, lifestyle and furniture sector, comprising a dyed leather, in particular according to any of the claims 14 to 16 or obtainable by a method according to claims 1 to 12, having a rub fastness RFT with a grade in a range of 4 or more, determined according to ISO 11640: 2012 and ISO 105 A03.

In this context, it is even more preferred if the leather comprises a rub fastness RFT with a grade in a range of 4 to 5, in particular 4.5 to 5, determined according to ISO 11640:2012 and ISO 105 A03.

An exemplary article according to the invention may be in particular a shoe that is constructed in multiple parts and comprises, in particular, for example, coated and dyed regions and uncoated and undyed regions. Further, the article may comprise portions made of materials other than leather, for example, in the case of a shoe, a sole made of plastic. Such a constructed product can be easily produced by the method according to the invention since the method is in particular designed to preferentially dye only those areas of the product where the surface of the leather has been previously coated. In this context, it is also a particular advantage that such areas of the product which comprise a material other than leather, i.e. contain, for example, plastic or metal, are not dyed under the process conditions according to the invention.

Accordingly, another example of a product according to the invention can also be a multi-part constructed bag, which can be selectively or specifically dyed using the method according to the invention, in that only those areas of the bag are dyed which have previously been coated according to the method according to the invention, and wherein in particular again, for example, non-coated leather sections as well as metal or plastic applications remain undyed or are not dyed within the scope of the method according to the invention.

Thus, within the scope of the present invention, in contrast to the prior art, it is possible to dye entire leather products, such as for example in particular shoes, bags, articles of clothing and furniture coverings, evenly and uniformly and likewise selectively in areas provided for this purpose.

For further details on the product according to the present invention, reference can be made to the above explanations on the other aspects of the invention, which apply accordingly with respect to the product A further subject-matter of the present invention—according to a fifth aspect of the present invention—is a method for dyeing leather which comprises a coating on its surface, in particular for producing a dyeing with a high rub fastness, with an organic colorant in a supercritical fluid, wherein the coated surface of the leather, in particular the coating, is dyed with the organic colorant in the supercritical fluid.

In particular, a special advantage of the present invention is that previously coated leathers can be dyed with the organic colorant in the supercritical fluid. Thus, the present invention can be applied in a flexible and uncomplicated manner both to leathers which, in particular—as previously described—have not yet obtained a finish and to leathers which have already been finished but are still undyed. The present invention thus opens up in particular a wide scope for the dyeing of leather, within the frame-work of which a preferably environmentally friendly dyeing process can be applied in particular efficiently and effectively to a wide variety of leathers.

For further details on the method according to the present invention, reference may be made to the above explanations on the other aspects of the invention, which apply accordingly to the method for dyeing leather provided with a coating on its surface.

A further subject-matter of the present invention—according to a sixth aspect of the present invention—is a method for dyeing a product comprising a leather which comprises a coating on its surface, in particular for producing a product having a dyeing with a high rub fastness, with an organic colorant in a supercritical fluid, wherein the coated surface of the leather, in particular the coating, of the product is dyed with the organic colorant in the supercritical fluid.

For further details on the method according to the invention, reference can be made to the above explanations on the other aspects of the invention, which apply accordingly with respect to the method for coloring a product comprising a leather which is comprised on its surface with a coating.

The subject-matter of the present invention is exemplified below in a non-limiting manner by the working examples.

Carbon dioxide (CO2): The carbon dioxide used is obtained from a tank where it is present at 60 bar. The carbon dioxide comprises a purity of over 99.9% and comes from the supplier Praxair.

Solvent Red 111: The colorant or dye used has the chemical name 1-(methylamino) anthraquinone and is marketed under the product name Solvent Red 111. It is a pure dyestuff without any colorants. Solvent Red 111 comprises a purity of 98% and is purchased from Clamant.

Leather: The (cow) leather used is conventionally produced without the use of dyes and is provided by Heller Leather. The cow leather is produced using the chrome tanning process and is undyed and uncoated. It is sold as furniture leather, the thickness is about 1 mm. The fat content is estimated to be between 2% and 12%. This is according to a usual value for a furniture leather.

Finishing: The coating applied to the leather is a polyurethane-based finish. It consists of several components, wherein all components are supplied by Langro and are mixed according to recipe LC 105-19 (see Table 1), also supplied by Langro, to form a finish suitable for furniture leather. The recipe distinguishes between a primer and a finish, which are applied one after the other.

TABLE 1

Finishing recipe used
Furniture recipe LC 105-19

| 1. Primer 2-3 × spraying | | 2. Top 2 × spraying | |
|---|---|---|---|
| Filler 5 | 50 | GW 5 | 50 |
| Water | 400 | GW 78 | 50 |
| Telaflex U 44 matt | 150 | Water | 450 |
| Telaflex U 410 | 100 | Telaflex U 44 matt | 150 |
| Telaflex A 118 | 100 | Telaflex U 410 | 150 |
| Telaflex U 529 | 50 | Telaflex U 500 | 100 |
| Auxilan VLM 29 | 50 | Auxilan VLM 29 | 50 |
| Σ | 900 | Σ | 1000 |

The numerical values listed are in grams

Equipment Used

Autoclave: eCO2-Plant Model S 5.2 L:

An eCO2 plant model S 5.2 L from the manufacturer eCO2 is used. The technical data of the autoclave are listed in Table 2 below. The autoclave is designed for processes in the supercritical range.

TABLE 2

Technical data eCO2 plant model S 5.2 L

| | |
|---|---|
| Temperature range | 35° C. to 50° C. |
| Working pressure | 0 bar to 250 bar (Overpressure) |
| Rotation (In- and Counter clock-sense) | 0 $min^{-1}$ to 50 $min^{-1}$ |
| Reactor volume | 5.2 L (length 835 mm; diameter 86 mm) |
| Basket volume | 3.2 L |

Finish Tester 9001 of the Company Bally—Rub Fastness Tester:

A "Finish Tester 9001" from the company Bally is used to test the rub fastness. The test specimens are manually fixed in a holder and a rubbing finger is applied. The holder can be moved back and forth electronically. The number of these uniaxial horizontal movement cycles can be pre-programmed. The rubbing finger is fixed horizontally by a static arm and presses on the test specimens by means of a standard weight resting on it. A holder for a felt pad is supplied at the contact point between the friction finger and the test sample.

CAS 140CT Spectrometer with RMH 45 Reflectance Measuring Head:

For the analysis of the staining a spectrometer is used, which analyzes the reflected spectrum of a halogen lamp. The RMH 45 reflection measuring head used has a halogen lamp as its light source. The light emitted by the lamp strikes the specimen at the test surface. Part of the light is absorbed by the specimen and part is reflected. The reflected light is transmitted via a fiber optic cable. The entire setup is located in a black painted housing.

The angle of entry and the angle of exit of the light are 45°. The reflected light then reaches the CAS 140CT spectrometer via the fiber optic cable. This has a CCD detector. CCD detectors consist of light-sensitive electronic components and provide information about the brightness of the incoming wavelengths. The spectrometer can detect wavelengths between 380 nm and 1040 nm (Instrument Systems GmbH). The reflectance measuring head and spectrometer are from Instrument Systems.

Analytical Scale:

The weights of leather samples dyed according to the invention are measured using an analytical scale from the company KERN & SOHN GmbH. The resolution of the analytical balance used is 0.1 mg.

Methods

Cutting and Coating of the Samples:\

Samples measuring 60×100 mm (approximately 0. 065 ft2) are taken from the croupon and lower neck of a leather of cow.

The samples are coated according to the method of the invention. For this purpose, the finish described above is applied by spraying, wherein 2 g/ft2 of the composition is applied per cycle. For the primer, 3 to 7 coating cycles are performed, and for the finish, 2 cycles are performed.

Sample Arrangement:

Specimens are arranged horizontally with the coated surface, i.e., grain side, facing up. The flesh side of the leather thus faces downwards. The colorant is evenly distributed in the center of the uppermost samples.

Photographing the Samples:

The photo documentation of individual samples is carried out with the aid of a photo box. The box shields ambient light and has its own light source. This guarantees constant light conditions between the photos. For a photo with more than 14 samples, photos are taken in daylight.

Pressure Build-Up and Release:

Pressure build-up and depressurization process in the autoclave are uniformly pre-programmed in a PLC control for all experiments. When pressure is built up in the autoclave, a valve connected to the gas tank, in this case a CO2 tank, opens and the pump is switched on. The incoming gas, especially CO2, is compressed until the target pressure is reached.

Due to turbulence and temperature differences, the pressure fluctuates at the beginning. A control system builds up additional pressure or relieves it as required. To guarantee equilibrium in the reactor, 15 minutes are spent in this process step.

The expansion rate in the autoclave is preset for pressures above 10 bar, so the outlet valves are controlled to maintain an expansion rate of 5 bar/min. For the last 10 bar, the expansion rate is reduced to 1 bar/min.

Cleaning of the Reactor:

The autoclave is purified after each experiment. For this purpose, the reactor is flushed several times. A cleaning cycle is a series of pressure build-up and depressurization processes. The compressed carbon dioxide dissolves any residual colorant and transports it to the separator during the depressurization process. There, the CO2 relaxes and can no longer dissolve the colorant residues, causing them to precipitate. A test is then carried out with a leather sample, but without colorant. If the sample is undyed, a new test can be run with colorant.

Analytics

Analysis of Rubbing Fastness:

For the determination of rub fastness, felt pads are rubbed over the samples using the Finish Tester 9001 from Bally. The abrasion of the dye onto the felt pads is observed and graded using a gray scale.

First, the samples are clamped in the holder and stretched approximately 10% in length. Then, square white felt pads from James Heal are used for the rub fastness tests. These are in accordance with the ISO 11640:2012 standard. In all tests, the friction finger is loaded with a standard weight. As a result, the felt pad is pressed onto the leather specimen with a force of 5 N. The friction finger then travels over the sample for 50 cycles.

Three different pads are prepared for different rub fastnesses (DIN EN ISO 11640):

Test with Dry Felt

For this test, the felt pad is placed unchanged in the friction finger.

Test with Wet Felt.

For this test, the felt pads are heated in demineralized water until the water starts to boil. After one minute, the hotplate is turned off and the felt pads cool to room temperature. A felt pad is then removed and lightly pressed to reduce the water content. Sufficient liquid is left in the felt pad so that a moist film is formed during the friction cycles.

Test with Felt Dampened By Artificial Sweat.

For this test, the felt pads are first prepared as in the test with wet felt. Then they are strongly compressed so that the water content is reduced to a minimum. The felt pads are then soaked in a perspiration solution for five minutes. This solution resembles artificial sweat (cf. Tab. 3). Finally, the amount of liquid is reduced as in the test with wet felt so that a moist film forms in the test.

TABLE 3

Composition of one liter of artificial sweat

| Component | Amount |
|---|---|
| Water (demineralized) | 994 $cm^3$ |
| Sodium chloride (common salt) | 5 g |
| Ammonium hydroxide (0.880 $g/cm^3$) | 6 $cm^3$ |

The rub-off of the color from the sample onto the felt pad is graded using a gray scale. The gray scale used comes from the manufacturer James Heal and is in accordance with the ISO 105 A03 standard. The grades range from 1 to 5 and are divided into increments of 0.5. An undyed felt pad corresponds to the best rub fastness and obtains the RFT grade 5. The abbreviation RFT stands for RubFastnessTest. Intensively colored felt pads are given a lower grade, whereby an RFT grade of 1 corresponds to the worst grade. For grading purposes, the most dyed area on the felt pad is considered.

Analysis of the Coloring of the Leather:

To grade the dyeing of the leather, a spectrometer is used to analyze the reflected spectrum of the dyed samples. Using the SpecWinPro software, the spectrum of a reference sample is first measured. In the context of this work, an industrial reference white is used. The actual sample is then measured. The software calculates the color deviation of the sample from the reference.

Standard Color Space According to DIN EN ISO 11664-4:

The spectrometer converts the incoming wavelengths into basic values X, Y, Z of the CIE standard color space (CIE—Commission internationale de l'eclairage). This triplet of numbers can be used to describe any color, wherein X, Y and Z stand for the theoretical primary colors red, green and blue. Equal distances in this color space do not correspond to equal sensory distances between color stimuli (standard DIN EN ISO 11664-4).

In order to convert the basic values into the subjective relationship of human perception, a conversion into the CIELAB color space is necessary (cf. formulas 1 to 3). The basic values Xn, Yn, Zn are determined via the reflection of a reference white and compared with the measurements X, Y, Z of the samples. Through this comparison, all color values determined with this method are to be understood only relative to the standard reference.

Formulas 1 to 3:

$$L^* = 116 \cdot f\left(\frac{Y}{Y_n}\right) - 16 \tag{1}$$

$$a^* = 500\left[f\left(\frac{X}{X_n}\right) - f\left(\frac{Y}{Y_n}\right)\right] \tag{2}$$

$$b^* = 200\left[f\left(\frac{Y}{Y_n}\right) - f\left(\frac{Z}{Z_n}\right)\right] \tag{3}$$

For the determination of the colorations, hue h_ab^°, brightness L^* and saturation (chroma) C_ab^* are determined from the L*a*b*-coordinates (cf. formulas 4 and 5):

$$h^\circ_{ab} = \cot\left(\frac{a^*}{b^*}\right) \tag{4}$$

$$C^*_{ab} = \sqrt{a^{*2} + b^{*}2} \tag{5}$$

The L*a*b* color space includes the wavelengths of visible light and divides the colors into 360°. The hue-angle h_ab^° [°] provides information about the color. A high saturation (chroma) C_ab^* is a sign of intense coloration. For a colorless sample, the chromaticity is 0. Then, the brightness L^* can be used to determine whether the sample is black, white, or a shade of gray in between. The brightness can assume values between 0 (black) and 100 (white).

Weight Measurement:

The analytical scale is used for weight measurement. The samples are weighed immediately before the test and immediately after the test. The amount of colorant is determined immediately before the test.

Procedure and Evaluation:

According to the method of the invention, leathers coated according to method step (a) are placed in an autoclave with a defined amount of colorant for dyeing. Leathers coated with more than 10 g/ft2, in particular 12 g/ft2, of primer and 4 g/ft2 of finish have proved to be particularly suitable. For leather samples comprising a coating of 12 g/ft2 primer and 4 g/ft2 finish, the amount of coating applied corresponds to a layer thickness of approx. 23 ∞m.

After the leather samples and the colorant have been placed in the autoclave, the pressure is elevated until the density of the carbon dioxide is sufficient to dissolve or disperse the, in particular powdery, colorant. The leather coating, which preferably comprises a high affinity to the colorant, can absorb the colorant dissolved or dispersed in the CO2, thus reducing the concentration of colorant in the CO2 and allowing new colorant to be redissolved. This process is repeated preferentially until the coated leather surface, in particular the coating of the leather, is saturated with colorant or until there is no more excess colorant in the process that can be dissolved in the CO2.

This procedure ensures that only as much excess colorant remains in the process as can be dissolved in the maximum volume of supercritical carbon dioxide used. Depending on the filling volume of the autoclave with coated leather, the excess colorant quantity, which is not absorbed by the leather coating but remains dissolved in the CO2, can be almost neglected when the autoclave is heavily filled.

It may be useful to increase the amount of colorant at higher densities of the supercritical fluid, i.e. with increasing pressure and decreasing temperature. If the colorant quantity is not increased, the dyeing intensity may be reduced because the colorant solubility or dispersibility in the CO2 is increased, whereupon extraction of the already impregnated colorants may occur when the pressure is released. Process parameters with low colorant solubility or dispersibility are therefore preferred, in particular also in order to reach a pressure range as quickly as possible at the end of the process during pressure relief, in which the colorant solubility or dispersibility approaches zero. Raising the temperature can help to reduce the colorant solubility or dispersibility. The temperature increase can take place both before and during the pressure reduction but is not absolutely necessary.

Each leather section produced according to the method of the invention is then analyzed as previously described, wherein five measurements are performed per section or sample. All measurements are used for calculations of mean values. In addition, standard deviation, maximum and minimum are determined. A small standard deviation from the mean value is an indication of uniform dyeing.

Solubility Studies on the Colorant Solvent Red 111:

The solubility of Solvent Red 111 in compressed carbon dioxide particularly is dependent on pressure and temperature, as also represented in FIG. 1. Pressures between 60 bar and 140 bar and temperatures between 20° C. and 80° C. are considered here. It can be seen that the solubility of the colorant decreases in particular with increasing temperature. This is due to the reduction in the density of the carbon dioxide. On the other hand, if the pressure, and thus the density, is elevated, the solubility of the colorant in the CO2 preferentially increases.

In particular, the lowest pressure at which the method achieves intensive coloration is of interest. At higher pressure, the material input for the construction of the reactors increases. In addition, the pressure also increases the safety requirements, which are associated with additional effort as well as costs. From the solubility study, it can be seen that in particular at a temperature of 40° C. and a pressure of 100 bar, an advantageous ratio can be set between the dissolved or dispersed colorant and the colorant present as a solid or in particulate form.

Dyeing of Leather Samples with Different Amounts of Colorant:

The dye consumption, which should be used in particular at least substantially for intensive dyeing, is determined in grams per square foot. The amount of colorant required depends in particular on the intended intensity of the dyeing, as also shown in the overview of the leather samples according to FIG. 2. An intensive or preferably the most intensive possible dyeing and for this the lowest dye consumption [g/ft$^2$], at which a further increase of the dye amount no longer produces significant improvements of the dyeing, are preferred.

For this purpose, tests are repeated with 0.19 ft2, 0.97 ft2 and 1.94 ft2 (3, 15 and 30 samples) of leather surface to be dyed per basket load with increasing colorant quantity until maximum coloration is achieved. Subsequently, the samples for which the dyeing cannot be further improved are subjected to a rub fastness test. Overall, this allows the effects of machine loading and the amount of dye used on the dyeing result to be observed. Table 4 shows the tests carried out and the dye quantities used, which are increased in steps of 0.02 g/ft2. The aim is to determine a dye quantity matched to the amount of leather to be dyed, which leads to good dyeing results and ensures satisfactory rub fastness.

TABLE 4

Overview of the tests to determine an optimum colorant quantity

| Basket load | Amount of colorant used [g/ft$^2$] | |
|---|---|---|
| [ft$^2$] | from | to |
| 0.19 | 0.22 | 0.40 |
| 0.97 | 0.04 | 0.18 |
| 1.94 | 0.04 | 0.14 |

The parameters pressure P, temperature T, test duration t and rotation speed n are preferentially selected as follows:

TABLE 5

Test parameters - colorant optimization

| Test parameters | P [bar] | T [° C.] | t [min] | n [min$^{-1}$] | A [ft$^2$] |
|---|---|---|---|---|---|
| Value | 100 | 40 | 120 | 10 | 1 |

Figure 2:
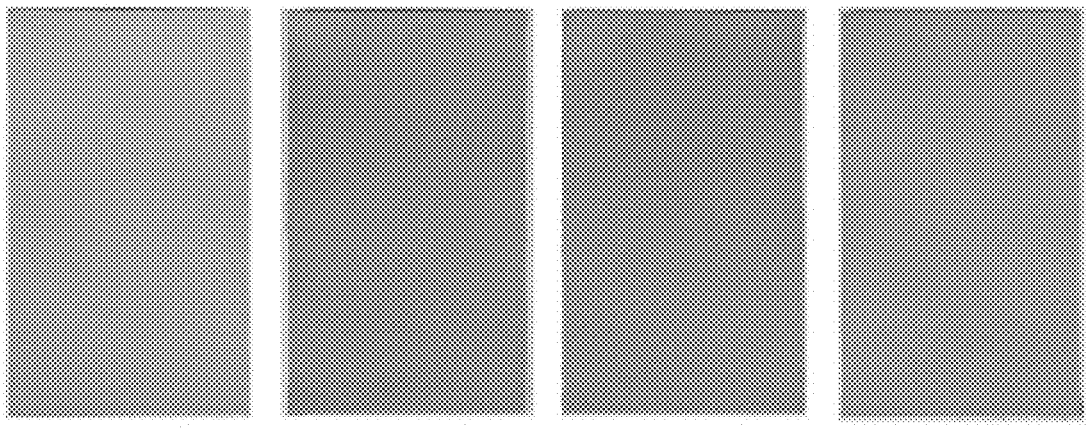
FIG. 2 depicts a series of leather sections dyed according to the invention with a total area of 1.94 ft2, wherein the leather sections were dyed with 0.04 to 0.14 g of the organic colorant per square foot of leather area.

The increase in the amount of colorant used with a surface area to be dyed of 1.94 ft2, i.e. 30 samples in the basket, and the resulting color values in the L*C*H* color space can be seen in FIG. 2. An excess of color occurs at a colorant quantity of 0.14 g/ft2.

Table 5 compares the measured values of the leather samples dyed with 0.10 g/ft2, with 0.12 g/ft2 and with 0.14 g/ft2 dye. The standard deviations are almost identical for all three amounts used and are about 5% for the saturations, about 2.5% for the brightness and about 7% for the hues. Visually, no inhomogeneity of colorant distribution can be detected in any sample. Even with small amounts of colorant, for example 0.04 g/ft2, the coloration is homogeneous.

TABLE 5

| Comparison of color values achieved with 1.94 ft2 | | | |
|---|---|---|---|
| Color values in | Amount of colorant used | | |
| L*C*H* color space | 0.10 g/ft$^2$ | 0.12 g/ft$^2$ | 0.14 g/ft$^2$ |
| Brightness L* [%] | 54.7 | 55.2 | 54.1 |
| Saturation C* [%] | 50.3 | 49.9 | 50.1 |
| Hue H* [°] | 20.6 | 20.3 | 20.8 |

The tests with a surface to be dyed of 1.94 ft2 show that an increase in the amount of dye can in principle lead to an improvement in the dyeing results. These results cannot be further improved after reaching their maximum values, in particular because the dye uptake of the coating is limited and saturation occurs. Additional dye can therefore no longer be absorbed. Particularly positive dyeing results are obtained with a surface area to be dyed of 1.94 ft2, in particular with a colorant quantity of 0.10 g/ft2.

Figure 3:
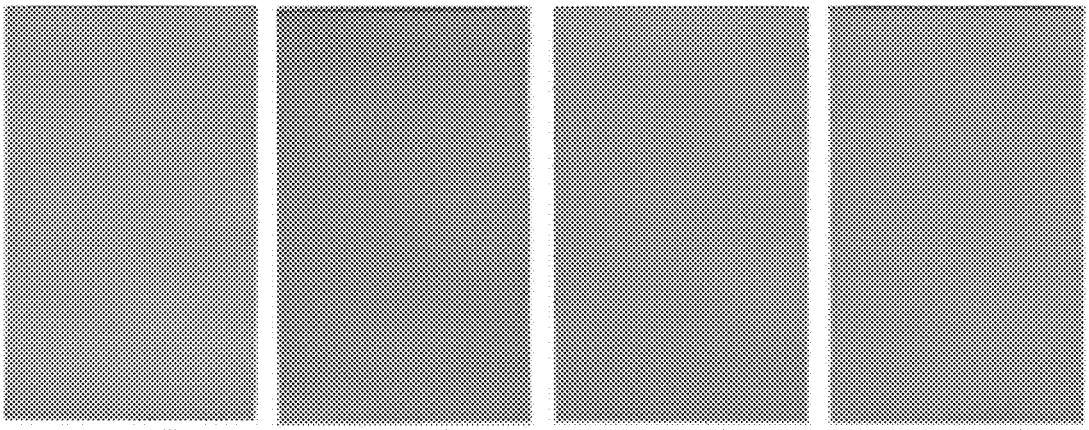
FIG. 3 depicts a series of leather sections dyed according to the invention having a total area of 0.97 ft2, wherein the leather sections were dyed with 0.04 to 0.18 g of the organic colorant per square foot of leather area.

In dyeing tests with a surface to be dyed of 0.97 ft2, the color values obtained behave similarly. Consistent color values are obtained from 0.14 g/ft2 colorant, an excess of colorant at 0.18 g/ft2 (see Tab. 6 and FIG. 3). The standard deviation of the saturation reaches a maximum value of about 4% for intensive dyeing results for a dye amount of 0.18 g/ft2, for the measured brightnesses it is a maximum of about 2% (0.16 g/ft2 dye) and for the hues about 5% for 0.16 g/ft2 dye. An even distribution of the colorant over the coating surfaces can therefore also be seen here over all the colorant quantities used.

TABLE 6

| Comparison of the color values achieved with 0.97 ft2 | | | |
|---|---|---|---|
| Color values in | Amount of colorant used | | |
| L*C*H* color space | 0.10 g/ft$^2$ | 0.12 g/ft$^2$ | 0.14 g/ft$^2$ |
| Brightness L* [%] | 57.7 | 56.6 | 56.8 |
| Saturation C* [%] | 47.6 | 48.9 | 48.4 |
| Hue H* [°] | 18.0 | 18.4 | 18.2 |

Figure 4:
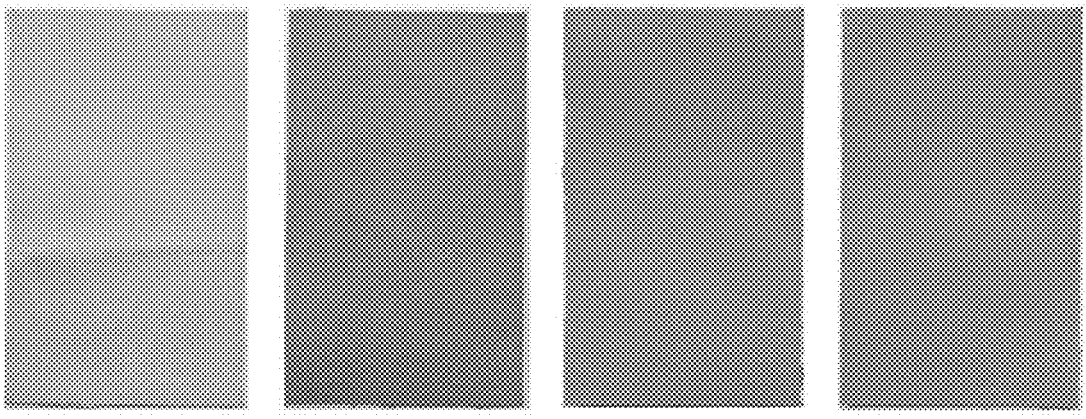
FIG. 4 depicts a series of leather sections dyed according to the invention with a total area of 0.19 ft2, wherein the leather sections were dyed with 0.22 to 0.40 g of the organic colorant per square foot of leather area.

Tests with 0.19 ft2 of leather to be dyed also show a similar picture (see FIG. 4). The dyeing results obtained can be increased up to a colorant quantity of 0.36 g/ft2. A further increase in the amount does not lead to any measurable improvement. An excess of colorant is observed at a dye amount of 0.40 g/ft2. Table 7 lists the determined dye values that occur at 0.36 g/ft2, 0.38 g/ft2 and 0.40 g/ft2. Among the intensive dyeing results, the standard deviation of saturation and hue takes the highest values of about 3% and 4%, respectively, at 0.38 g/ft2 dye. The standard deviation of the brightness reaches the highest value of approx. 2% at a dye amount of 0.40 g/ft2. For all samples, regardless of the amount of dye used, there is no inhomogeneity of the coloration on the sample surfaces.

TABLE 7

| Comparison of color values achieved with 0.19 ft2 | | | |
|---|---|---|---|
| Color values in | Amount of colorant used | | |
| L*C*H* color space | 0.36 g/ft$^2$ | 0.38 g/ft$^2$ | 0.40 g/ft$^2$ |
| Brightness L* [%] | 55.2 | 55.5 | 55.6 |
| Saturation C* [%] | 49.2 | 48.6 | 49.8 |
| Hue H* [°] | 18.9 | 18.8 | 19.0 |

Rub Fastness of Dyed Leather Samples

Figure 5:
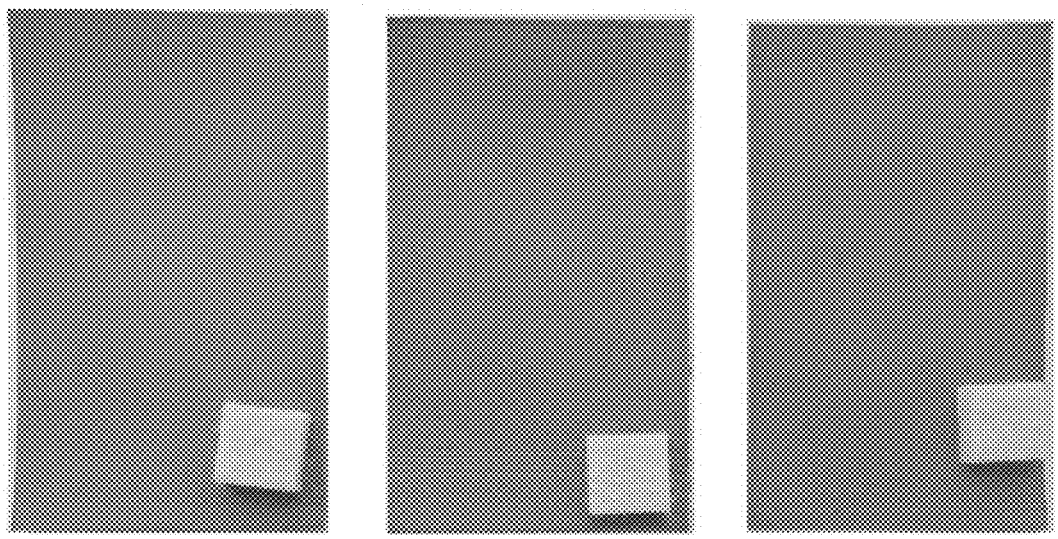
FIG. 5 depicts a series of leather sections dyed in accordance with the invention as part of the rub fastness test using a dry felt pad.

The results of the rub fastness tests carried out according to DIN EN ISO 11640 are listed in Table 8. Irrespective of the reactor loading and the amount of colorant used, intensively dyed samples show no color abrasion if the felt pads are dry or moistened (FIG. 5). Similarly, intensely colored leathers can be obtained even at lower colorant amounts than the values given in Table 8, for example in an amount range of 0.22 g/ft2 at a surface area of 0.19 ft2, which also comprise high rub fastnesses, in particular with a score of 5, both in the test with dry and with wet felt pads and in the test with felt pads with perspiration solution.

Figure 6:
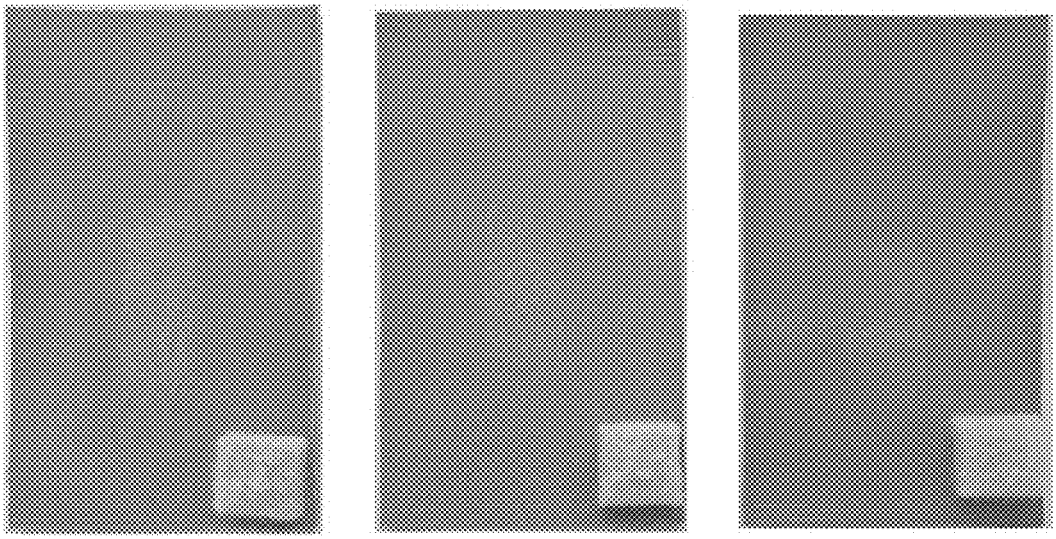
FIG. 6 depicts a series of leather sections dyed according to the invention during the rub fastness test using a felt pad with perspiration solution.

Finally, the samples impregnated with colorant amounts above the solubility limit of the colorant in the coating and tested with felt pads previously soaked in artificial sweat show slight discoloration (FIG. 6). The results of the rub fastness test thus show impressively that even in the presence of excess colorant, significantly better rub fastness can still be achieved than for conventionally dyed leather.

TABLE 8

| Achieved values of rubfastness tests | | | | |
|---|---|---|---|---|
| Basket load | Amount of colorant | Felt pad conditioning | | |
| [pcs. (area)] | used [g/ft$^2$] | dry | wet | sweat |
| 3 | 0.36 | 5 | 5 | 4 |
| (0.19 ft$^2$) | 0.38 | 5 | 5 | 4 |
| | 0.40 | 5 | 5 | 3.5 |
| 15 | 0.14 | 5 | 5 | 4.5 |
| (0.97 ft$^2$) | 0.16 | 5 | 5 | 4 |
| | 0.18 | 5 | 5 | 3.5 |
| 30 | 0.10 | 5 | 5 | 4.5 |
| (1.94 ft$^2$) | 0.12 | 5 | 5 | 4 |
| | 0.14 | 5 | 5 | 3.5 |

6. Conclusion

On the basis of the studies carried out, it can be shown that an, in particular waterless, dyeing process in a supercritical fluid, in particular in supercritical carbon dioxide, can be successfully applied to leather that has been coated, in particular in a preceding coating step. The colorant, or in particular the dye Solvent Red 111, can be successfully impregnated into a coated leather surface, in particular in the form of a polyurethane coating applied to the surface of the leather samples. Tests with other colorants show that this principle can be transferred to common disperse dyes, solvent dyes and food dyes. Preferentially, the flesh side of the leather always remains undyed.

It is considered particularly advantageous that in particular intensive dyeing of the leather can already be achieved at a pressure of 100 bar, a temperature of 40° C. and, if necessary, a rotation of 10 min-1. These comparatively moderate process conditions are also advantageous from an economic perspective, in particular also taking into account the design of the apparatus, in particular the autoclave, in which the method according to the invention is carried out.

For the aforementioned process parameters, in particular minimal colorant requirements can be achieved for intensive coloring. In comparison, a conventional spray dyeing process requires, for example, 10 g/m$^2$ or 0.93 g/ft$^2$ of a liquid dye for a coating layer. Accordingly, the savings in colorants within the scope of the present invention compared to conventional methods can amount to over 80%.

Another special feature of the method according to the invention is that the apparatus used, i.e. in particular an autoclave used, can be purified of any remaining colorant residues by the use of compressed carbon dioxide. Accordingly, the use of solvents or mechanical cleaning can be dispensed with. This makes it possible in particular to use different colorants in the same autoclave.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

The invention claimed is:

1. Method for dyeing leather with an organic colorant in a supercritical fluid, the method comprising:

coating a surface of the leather to provide a coated surface of the leather, wherein the coating comprises an organically based varnish; and dyeing the coated surface of the leather with the organic colorant in the supercritical fluid.

2. The method according to claim 1, wherein only the coated surface of the leather is dyed with the organic colorant in the supercritical fluid.

3. The method according to claim 1, wherein coating the surface of the leather comprises coating in amounts of 2 to 50 g/ft2.

4. The method according to claim 1, wherein the organic colorant comprises at least one dye.

5. The method according to claim 4, wherein the at least one dye comprises at least one of suspending agent-free disperse dyes, solvent dyes, food dyes, and pigments.

6. The method according to claim 1, wherein the supercritical fluid is obtained from supercritical carbon dioxide.

7. The method according to claim 1, wherein the dyeing of the coated surface of the leather is carried out under the admission of pressure and/or temperature.

8. The method according to claim 1, wherein the dyeing of the coated surface of the leather is carried out by impregnating the coated surface with the organic colorant.

9. The method according to claim 8, wherein the coated surface is impregnating with the organic colorant such that a high rub fastness is achieved having a score in a range of 4 or more according to ISO 11640:2012 and ISO 105 A03.

10. The method according to claim 1, wherein the organic colorant is used in amounts between 0.01 to 0.75 g/ft2 for dyeing the leather.

11. The method according to claim 1, wherein the organic colorant comprises a solubility in the supercritical fluid in a range of 10-3 to 10-8 M/M based on the molar amount of the supercritical fluid.

12. The method according to claim 1, wherein the surface of the leather is coated and the coated surface is dyed so as to produce a dyed leather having a rub fastness RFT with a grade in a range of at least 4 determined according to ISO 11640:2012 and ISO 105 A03.

13. A dyed leather having a rub fastness RFT with a score in a range of at least 4 determined according to ISO 11640:2012 and ISO 105 A03, the dyed leather being produced by the method of claim 1.

14. The dyed leather according to claim 13, wherein a skin side of the leather is coated.

15. The dyed leather according to claim 13, wherein the coated surface is impregnated with the organic colorant, the organic colorant comprising at least one of disperse dyes, solvent dyes, food dyes, and pigments.

16. Leather products having a rub fastness RFT with a grade in a range of at least 4 determined according to ISO 11640: 2012 and ISO 105 A03, the leather products being produced by the method of claim 1.

17. A method for dyeing leather having a coating comprising an organically based varnish on its surface, the method comprising dying the coating with an organic colorant in a supercritical fluid such that the coating of the leather is dyed with a high rub fastness.

18. A method for dyeing a product comprising a leather having a coating wherein the coating comprises an organically based varnish on its surface, the method comprising dying the coating with an organic colorant in a supercritical fluid such that the coating of the product is dyed with a high rub fastness.

* * * * *